United States Patent [19]

Benedick

[11] Patent Number: 4,474,118

[45] Date of Patent: Oct. 2, 1984

[54] VERTICAL, IN-LINE REGENERATIVE HEAT EXCHANGE APPARATUS

[75] Inventor: Edward H. Benedick, Lancaster, Pa.

[73] Assignee: Regenerative Environmental Equipment Co., Inc., Morris Plains, N.J.

[21] Appl. No.: 520,726

[22] Filed: Aug. 5, 1983

[51] Int. Cl.[3] ..... F23B 5/00; F23C 9/00; F23G 7/06

[52] U.S. Cl. ..... 110/211; 110/212; 422/175; 422/182; 431/5

[58] Field of Search ..... 110/203, 210, 211, 212, 110/213, 214; 431/5, 7, 170; 422/170, 171, 175, 182

[56] References Cited

U.S. PATENT DOCUMENTS

| | | | |
|---|---|---|---|
| 3,895,918 | 7/1975 | Mueller | 110/212 X |
| 3,951,082 | 4/1976 | Leggett et al. | 110/211 |
| 4,248,841 | 2/1981 | Benedick | 110/210 X |
| 4,252,070 | 2/1981 | Benedick | 110/211 |
| 4,353,720 | 10/1982 | Margraf | 422/171 |

*Primary Examiner*—Edward G. Favors
*Attorney, Agent, or Firm*—Nelson E. Kimmelman

[57] ABSTRACT

In one embodiment, the incinerator has three or more aligned stationary, vertical adjacent structures, each of which has a heat-exchange section covered partially by respective plates which are so arranged as to provide between adjacent ones of the sections substantially uniform gas flow paths via a common combustion chamber disposed above all of the sections. In another embodiment, generally cylindrical vertical and aligned sections are provided, each having a heat-exchange bed supported on a perforated member. The level of the heat-exchange elements in each section is kept very low. The tops of the three sections communicate with one another via a generally horizontal, combustion passageway formed between them into which at least one burner is placed. All unprocessed effluents which proceed through and from the top of one bed to the top of an adjacent bed will have traversed paths at more uniform velocities and will have been subjected to high temperature processing substantially all along that path thereby preventing incomplete incineration.

20 Claims, 4 Drawing Figures

3
3
31
32
33
34
35
36
37
38
39
40
41
42
43
44
46
47
48
49
50
51
55
56
57
58
59
62

VERTICAL, IN-LINE REGENERATIVE HEAT EXCHANGE APPARATUS

BACKGROUND OF THE INVENTION

A. Field of the Invention

This invention relates to incinerators and especially to stationary, vertical incinerators of the regenerative type.

B. Prior Art

Stationary incinerators using the heat-regenerative principle are known in the art. U.S. Pat. No. 3,895,918 which issued to James J. Mueller on July 22, 1975 teaches and claims incineration apparatus in which there is a central, high-temperature combustion chamber which communicates with three or more heat-exchange sections arranged around it. Each heat-exchange section of that apparatus includes a large number of heat-retaining elements confined between two substantially vertical, apertured retaining walls, often made, in the past, of metal. Inlet and outlet valves are associated with each section at the tops and bottoms thereof and the gas flow was generally horizontal. In my co-pending application, Ser. No. 06/391,110, filed June 23, 1982, vertically-oriented incineration sections were shown as arranged either in adjacent wedge-shaped configurations, or in a generally L-shaped configuration. There were inlet and outlet ducts and corresponding inlet and outlet valves associated with each section toward the bottom thereof in the spaces below the heat-exchange beds. A common combustion chamber was located atop all the sections. Flow of gas was primarily vertical through each vertical section and horizontal through the combustion chamber. In that application, in order to prevent industrial effluents from substantially short-circuiting the high temperature combustion zone, the up-coming effluent was introduced as a relatively high-velocity jet into the upper part of the combustion zone. This was accomplished by providing a cover for each section with an aperture specifically designed for that purpose. The jet increased turbulence in that zone for better mixing and helped to prevent relatively unimpeded lateral unprocessed or incompletely processed flow at the bottom of the zone from one section to the top of the adjacent section.

While the invention described in that application was successful in producing the desired result, the present invention offers other attractive alternatives, both in terms of relative simplicity and efficiency, to those former embodiments.

DETAILED DESCRIPTION OF THE DRAWINGS

Figure 1:
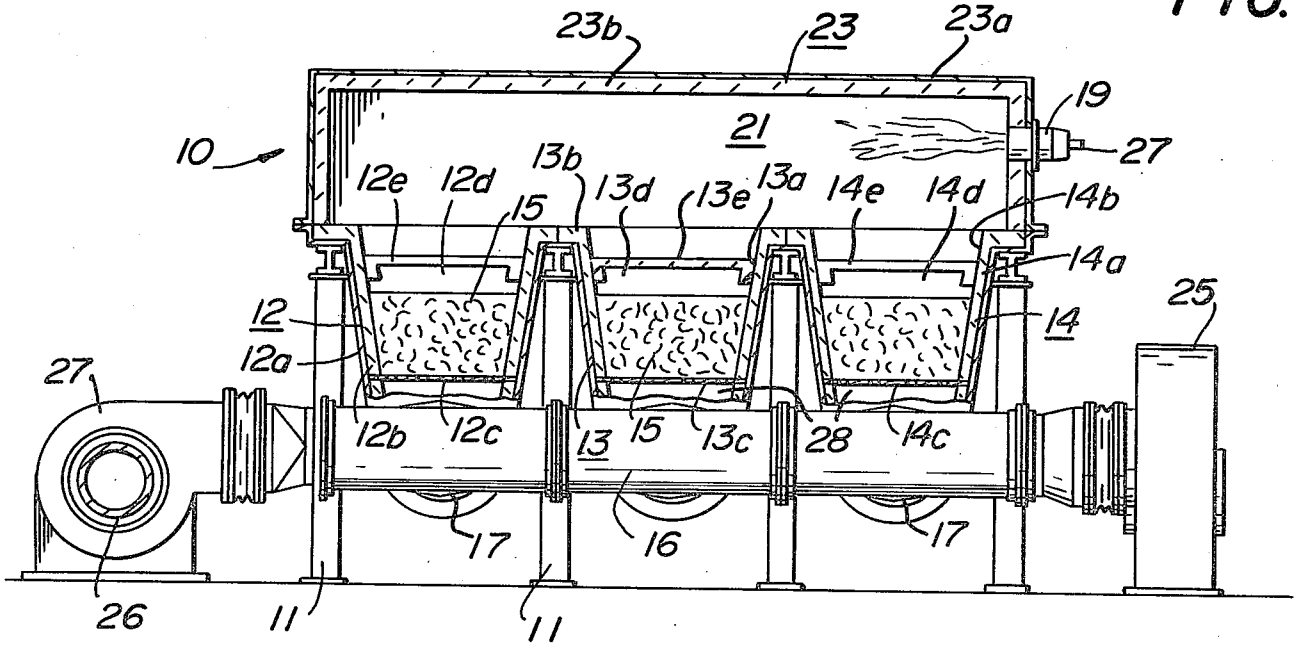
FIG. 1 is a side elevation view, partly sectional and partly broken away, of one form of the present invention.
Figure 2:
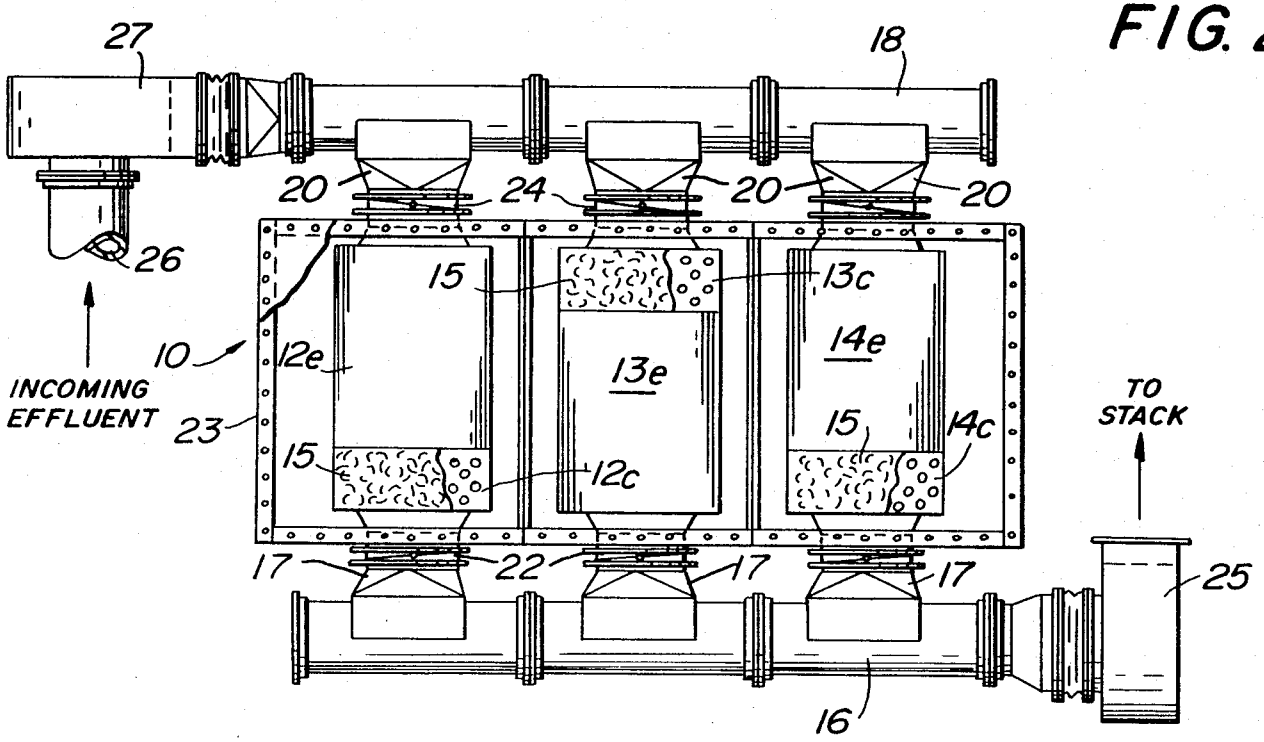
FIG. 2 is a plan view of the apparatus shown in FIG. 1 taken along the section line II—II of FIG. 1.

Referring to FIGS. 1 and 2, there is shown generally at the numeral 10 one form of the present invention which includes a number of incineration sections 12, 13 and 14 arranged in-line. In the form shown, they are each of a generally trough-like construction having a generally catenary cross-section. Each comprises an outer metallic sheath 12*a*, 13*a*, or 14*a* lined with a coating or layer of refractory material 12*b*, 13*b*, and 14*b*. Each has upper horizontal edges resting on or secured to I-beams fixed to the tops of posts 11. Within each of the sections 12, 13 and 14 and supported on respective metallic apertured plates 12*c*, 13*c* and 14*c* there is a bed 15 of ceramic heat-retaining elements. Below each of the perforated plates 12*c*, 13*c* and 14*c* there is a space 28 with which inlet and outlet feeder ducts 20 and 17 respectively connect via inlet valves 24 and 22 on opposite sides of the apparatus to main inlet and outlet ducts 18 and 16. To the former main inlet duct, the effluent from the industrial process is applied via duct 26 and optional input pump 27. The main exhaust duct 16 is coupled to the exhaust fan 25 that is adapted to be connected to a stack or other suitable way of venting the processed, purified effluent to the ambient atmosphere.

Above the three sections 12, 13 and 14 is a generally rectangular space for the combustion chamber 21 which is defined by enclosure 23 sheathed in metal 23*a* and lined with a refractory coating or layer 23*b*. The chamber communicates with the sections 12, 13 and 14 and is heated by a burner 19 which penetrates through a side wall of the enclosing member 23 and is supplied with fuel from outside. The enclosure 23 is detachably fixed by nuts, bolts, or other suitable means to the horizontal edges of sheaths 12*a*, 12*b*, 12*c* of the members 12, 13 and 14.

Plenums 12*d*, 13*d* and 14*d* are respectively provided above the beds 15 and are partially covered by plates 12*e*, 13*e* and 14*e*. These plates may be made of cast refractory material so dimensioned as not to completely enclose the plenum. As shown in FIG. 2, plate 12*e* is considerably shorter in length than the length of the plenum so that there is a space between the end of the plate through which gas may flow either to or from the heat-exchange bed 15. On the other hand, plate 13*e* is disposed so that there is a clearance at the top (as seen in FIG. 2). Plate 14*e* is arranged similar to plate 12*e* with the clearance at the bottom. This staggering of the openings tends to reduce the chance that some effluent passing upward through a heat-exchange bed 15 in one of the sections 12, 13 and 14 can follow a relatively short gas path horizontally toward the bottom of the combustion chamber 21 to the adjacent section, thereby residing in the chamber 21 for a time insufficient for complete incineration. By making paths of all effluent gas particles uniform, all effluent is made to dwell in the high temperature combustion zone for more uniform times to promote more complete combustion of the effluent.

While the plates 12*e*, 13*e* and 14*e* have been shown as being rectangular, there is no necessity for them to have any particular shape. Actually, the effluent gas path might be made just as uniform by having the shape of the openings triangular by cutting off one of their corners at the ends of the plates. Other forms of plates may also be used or, possible, a plate could be so fashioned as to cover the entire top of the bed but have a number of perforations formed in the region of one end.

Figure 3:
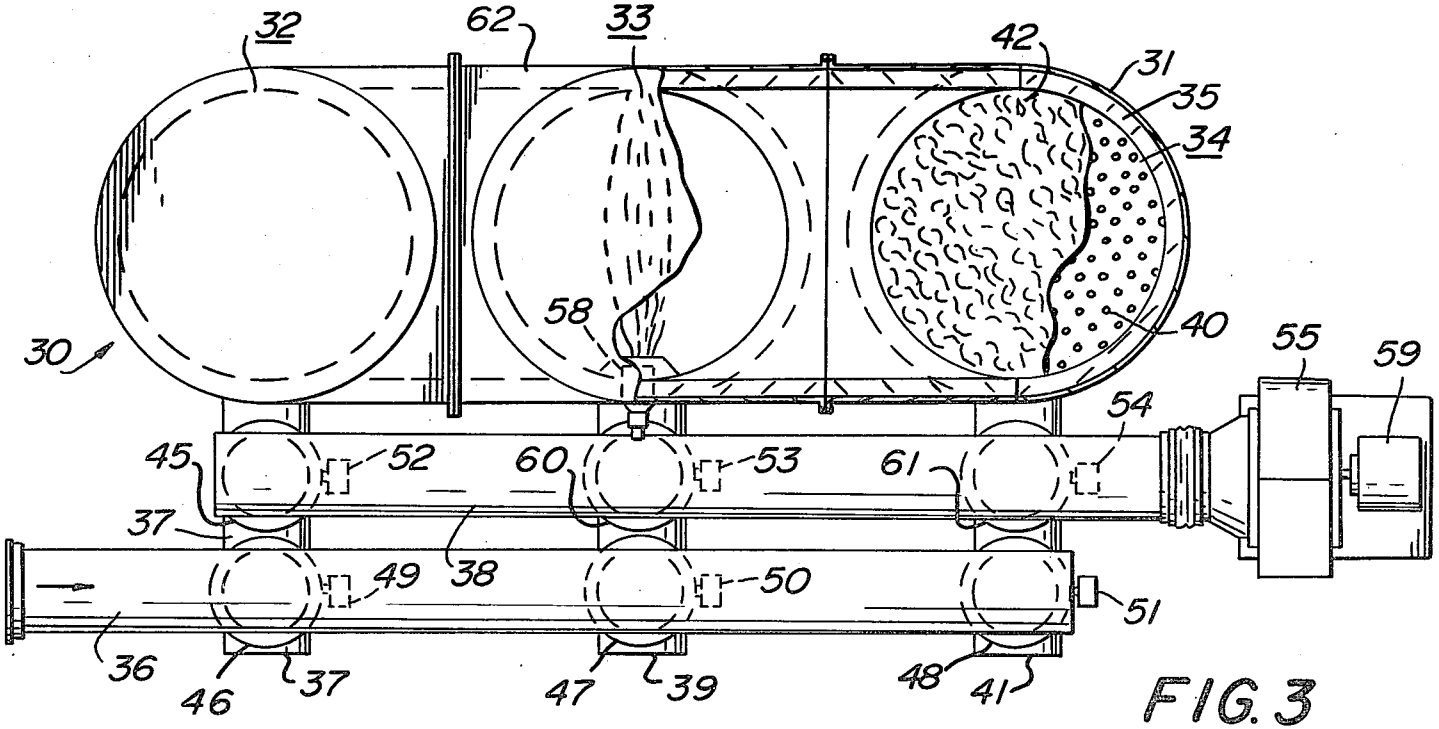
FIG. 3 is a plan view, partly broken away of the apparatus shown in FIG. 4 which is a second form of the present invention.
Figure 4:
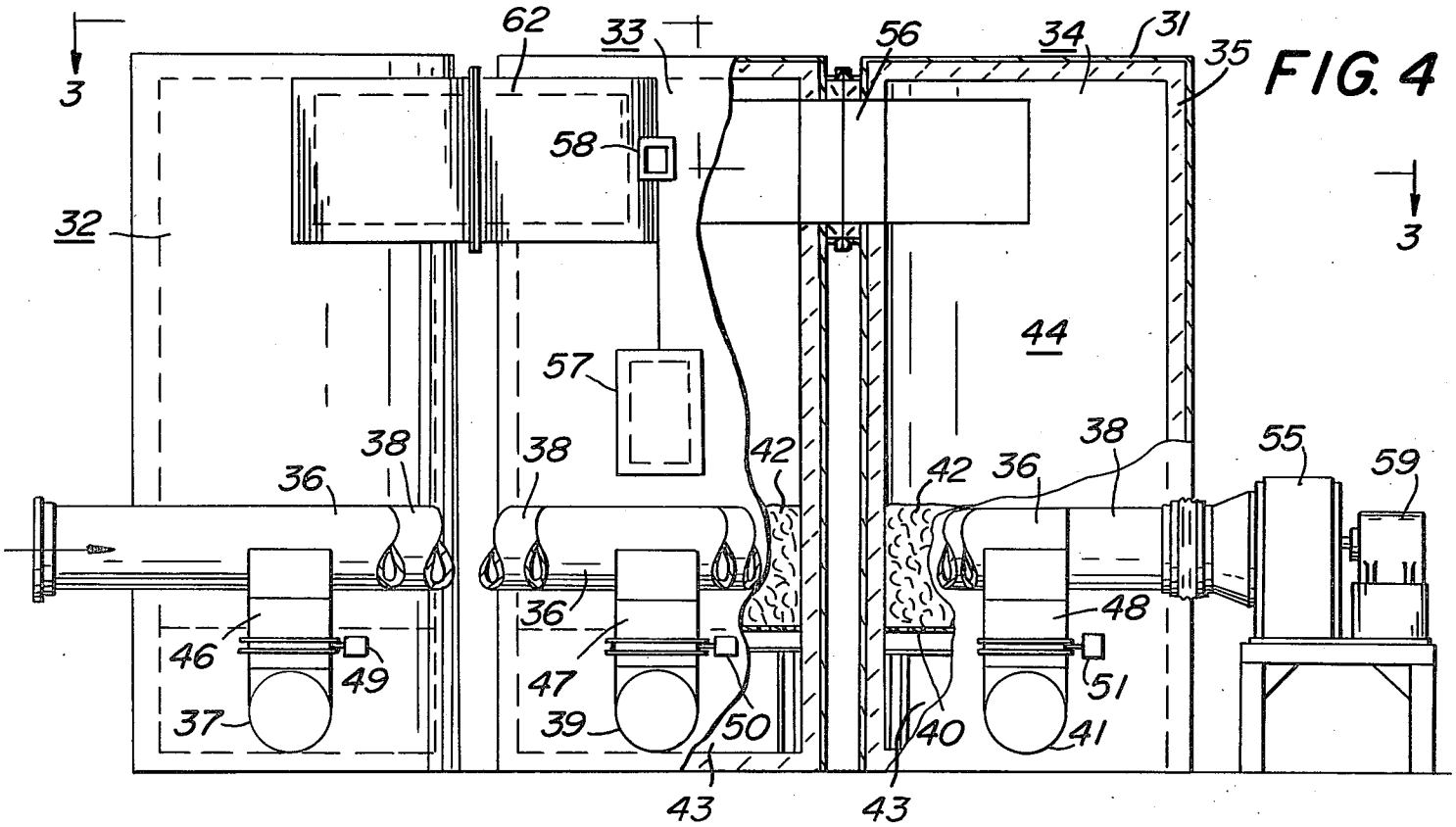
FIG. 4 is a side elevation view, partly sectional and partly broken away, of the apparatus shown in FIG. 3.

FIGS. 3 and 4 show still another form of the invention which is so constructed as to take advantage of vertical, in-line construction yet avoid the problem of insufficient oxidation due to short-circuiting of the combustion chamber by abbreviated flow of the effluent from one section to an adjacent section. In this form, apparatus shown generally at the numeral 30 comprises three generally vertical cylindrical columns 32, 33 and 34, aligned with one another. Each column has an outer metallic sheath 31 lined with a layer 35 of refractory material on its inner surface. Each includes a horizontal perforated metallic plate 40 on which a bed of ceramic, heat-retaining elements 42 are disposed. The level of the elements 42 is kept quite low relative to the overall height of the column. For example, it is shown as occupying approximately 22% of the entire volume of column 34 measured from supporting plate 40. Stated in another way, the pile's height is approximately 30% of the height of the column from perforated plate 40 up to the lower extremity of pasageway 56. This leaves a large plenum 44 traversed by all of the effluent before entry into passageway 56. This assumes a maximum gas velocity through the pile 42 of about 750 ft./min. at 1400° F. the upper portion of space 44 communicates with the corresponding upper portions of the space in columns 33 and 32 via a relatively wide and narrow rectangular cross-sectioned passageway 56 formed in a coupling, duct-like member 62. For example, the relation of the height to the width of passageway 56 could be in the ratio range of 1:2. A burner 58 penetrates the side wall of the central section 33, its flame intercepting most of the gas path through passageway 56. The burner 58 is fed fuel from the outside and is capable of raising the temperature in the gas path through the passageway to the temperature range 800°–1800° F. A door 57 is also provided to permit access to the interior of column 33.

In the enclosed spaces 43 below the perforated plates 40 of each column, the ends of feeder ducts 37, 39 and 41 are introduced. Those ducts communicate with the main exhaust duct 38 via vertical duct sections 45, 60 and 61 that include respective valve-controller means 52, 53 and 54. Exhaust duct 38 is coupled to a centrifugal exhaust fan 55 driven by motor 59, the output of the fan being applied to a stack (not shown) or other suitable means for disposing of the purified effluent.

The horizontal feeders 37, 39 and 41 are also coupled to main inlet duct 36 by vertical duct sections 46, 47 and 48 in which valve-controller subassemblies 49, 50 and 51 are disposed.

It may be seen that this form of the invention provides more uniform velocity for the effluent flowing from the top of one of the piles of heat-exchange elements 42 in a section to the top of the corresponding pile in the adjoining section. Also, it passes through a flame in a relatively narrow (in height) passageway 56 which tends to promote equal temperature gradient within it from top to bottom thereby helping to insure more complete combustion of all gases passing through the passageway.

Unlike the alternate constructions shown in my copending application Ser. No. 06/391,110 mentioned above, there is no need for cover plates with an aperture as shown therein since this incinerator design promotes more uniform gas velocity and the heat distribution in the combustion zone is more uniform. As a matter of fact, gas velocity in the apparatus shown in FIGS. 3 and 4 may be made as low as is consistent with complete incineration of the effluents that are processed by the apparatus.

Also, in the form of the invention shown in FIGS. 3 and 4, the cross-section of passageway 56 need not always be an elongated rectangle as shown. In smaller units the cross-section of psssageway 56 could be substantially square to accommodate the smaller flame of a a smaller burner.

Moreover, since the columns in FIGS. 3 and 4 are cylindrical, if columns of a different diameter are desired, the heights of the piles 42 may remain substantially constant, a factor which facilitates design of different installations. Nor is it necessary to limit the proportion of the total volume of each column occupied by each pile to 20%–30%. Depending on various considerations such as the incineration temperature, the average gas velocity, the properties of the effluent, the area of the cross-section of passageway 56, the size of the flame, the size and shapes of heat-exchange members 42, etc., those proportions may rise to about 40%–50% and still produce satisfactorily uniform velocity of most parts of the effluent stream.

The embodiments of the invention in which an exclusive property or privilege is claimed are defined as follows:

1. Incineration apparatus comprising:

(a) at least two heat-exchange sections arranged in line with one another, said sections each having a horizontal perforated member below which are respective confined spaces, (b) respective pluralities of refractory heat-exchange elements disposed on said perforated members, (c) means for supplying to said spaces, at preselected times and at predetermined flow rates, undesired effluents, (d) means for extracting from said spaces, at preselected times, gases which have been processed by said apparatus, (e) an elongated enclosure disposed on top of and in communication with all of said sections, said enclosure defining in cooperation with means for heating the interior thereof a high-temperature combustion chamber, and (f) cover means respectively partially covering predetermined portions of each of said sections wherein said uncovered portions of abutting sections are disposed as far as practicable from one another for increasing the effective length of gas flow from each one of said sections to abutting ones thereof.

2. The incineration apparatus according to claim 1 wherein said cover means comprises a plurality of plate-like members respectively placed above said plurality of heat-exchange elements, each of said plates being so disposed and dimensioned that there is an uncovered portion abutting one of its ends, and adjacent ones of said sections have their respective uncovered portions located at opposite ends thereof.

3. The incineration apparatus according to claim 2 wherein each plate has a generally rectangular shape which is partially congruous with the top of its associated section but there is a generally rectangular clearance between one end thereof and the corresponding end of the top of the associated section, said generally rectangular clearances of the adjacent sections being disposed at opposite ends.

4. The incineration apparatus according to claim 3 wherein there is a plenum between the top of each plurality of heat-exchange elements and said plate-like members.

5. The incineration apparatus according to claim 1 wherein each of said sections includes a generally trough-like configuration.

6. The incineration apparatus according to claim 1 wherein the rate of gas flow through said sections is between about 250–750 ft./min at about 1400° F.

7. The apparatus according to claim 1 wherein there are at least three of said sections and wherein the rate of gas flow through each is about 750 ft./min at about 1400° F.

8. The incineration apparatus according to claim 1 wherein there are three of said in-line sections and wherein said heating means is a burner disposed in said combustion chamber.

9. The incineration apparatus according to claim 1 wherein said (c) and (d) means are disposed on opposite sides of said sections.

10. The incineration apparatus according to claim 5 wherein each section is individually suspended from horizontal supporting members.

11. Incineration apparatus comprising:

(a) at least two separate vertical heat-exchange sections arranged adjacent to one another, the sections each having a pile of refractory heat-exchange elements supported by a gas-permeable member below which a confined space is disposed, (b) means for supplying to selected ones of said spaces at preselected times and gas flow rates, undesired effluents for processing by said apparatus, (c) means for extracting from said spaces, at preselected times, gases which have been processed by said apparatus, (d) passageway means near the top regions of said sections which bring said regions into gas flow communication with one another, and (e) heater means in said passageway and disposed to produce intense heat in said passageway and to intercept substantially all gas flow between the top of one of said piles to the top of an adjacent one of said piles.

12. The incineration apparatus according to claim 11 wherein said (b) and (c) means are disposed on the same side of said aligned sections.

13. The incineration apparatus according to claim 11 wherein said passageway has a height which is very small compared with its width.

14. The incineration apparatus according to claim 11 wherein said at least two heat exchange sections are aligned with one another.

15. The incineration apparatus according to claim 11 wherein the top of each pile is at a height such that the pile occupies less than about half of the volume of the column measured from the gas-permeable member upwards.

16. The incineration apparatus according to claim 11 wherein the volume occupied by each pile constitutes about 20%–50% of the entire volume of the section measured upwardly from the gas-permeable member.

17. The incineration apparatus according to claim 11 wherein the top of each pile is located approximately 30%–50% of the height of the column measured from the gas permeable member to the lowest extremity of said passageway means.

18. The incineration apparatus according to claim 11 wherein the cross-section of each of said sections is approximately a circle.

19. The incineration apparatus according to claim 11 wherein said heater means includes a flame which extends substantially across said passageway thereby to oxidize substantially all gas flowing through said passageway from one section to another.

20. The incineration apparatus according to claim 11 wherein the cross-section of said passageway is substantially an elongated rectangle with its longitudinal axis being substantially horizontal.

* * * * *